US008678956B2

(12) United States Patent
Thomas

(10) Patent No.: US 8,678,956 B2
(45) Date of Patent: Mar. 25, 2014

(54) PITCHERS AID FOR STRIKE ZONE ACCURACY

(76) Inventor: Brendan Lee Thomas, Abington, MA (US)

( * ) Notice: Subject to any disclaimer, the term of this patent is extended or adjusted under 35 U.S.C. 154(b) by 349 days.

(21) Appl. No.: 12/813,023

(22) Filed: Jun. 10, 2010

(65) Prior Publication Data

US 2010/0317465 A1 Dec. 16, 2010

Related U.S. Application Data

(60) Provisional application No. 61/268,234, filed on Jun. 10, 2009.

(51) Int. Cl.
*A63B 69/00* (2006.01)

(52) U.S. Cl.
USPC ..... 473/452

(58) Field of Classification Search
USPC ..... 473/150, 225, 497–501, 451, 452, 453
See application file for complete search history.

(56) References Cited

U.S. PATENT DOCUMENTS

| | | | | |
|---|---|---|---|---|
| 4,194,735 | A * | 3/1980 | Wilson | 473/452 |
| 5,318,290 | A * | 6/1994 | Sawyer | 473/217 |
| 6,945,883 | B1 * | 9/2005 | Williams et al. | 473/452 |
| 6,988,966 | B1 * | 1/2006 | Guzman | 473/452 |
| 7,338,395 | B1 | 3/2008 | Hurley | |
| 2004/0121862 | A1 | 6/2004 | Socci | |
| 2006/0234816 | A1 * | 10/2006 | Reason-Kerkhoff | 473/452 |
| 2007/0173356 | A1 | 7/2007 | Hapanowicz | |
| 2008/0188331 | A1 * | 8/2008 | Shimizu et al. | 473/451 |
| 2010/0216578 | A1 * | 8/2010 | Mejia Perez | 473/452 |
| 2010/0317452 | A1 * | 12/2010 | Lagano | 473/272 |
| 2010/0317465 | A1 * | 12/2010 | Thomas | 473/452 |
| 2011/0098136 | A1 * | 4/2011 | Maresh | 473/452 |
| 2011/0224028 | A1 * | 9/2011 | Slakey | 473/452 |

* cited by examiner

*Primary Examiner* — Gene Kim
*Assistant Examiner* — M Chambers
(74) *Attorney, Agent, or Firm* — Kenneth Bower

(57) ABSTRACT

Disclosed is a pitcher's aid for strike zone accuracy that serves the purpose of guiding a pitcher's body to the left or right side, inside/outside, of home plate in order to provide familiarity with how their body can be used to locate a pitch to the desired target. The new and unique invention utilizes a lightweight, rugged material and a small size to stay portable and provide the pitcher with an invention that can be used anywhere and anytime he wishes to practice. Practicing with this invention gives a pitcher confidence when pitching to either side of home, which in turn provides them with more confidence in their pitches, and provides them with the knowledge that they can get the outs needed when called upon by their coach.

12 Claims, 10 Drawing Sheets

Figure 1A:
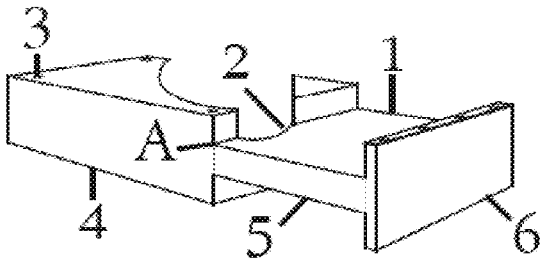

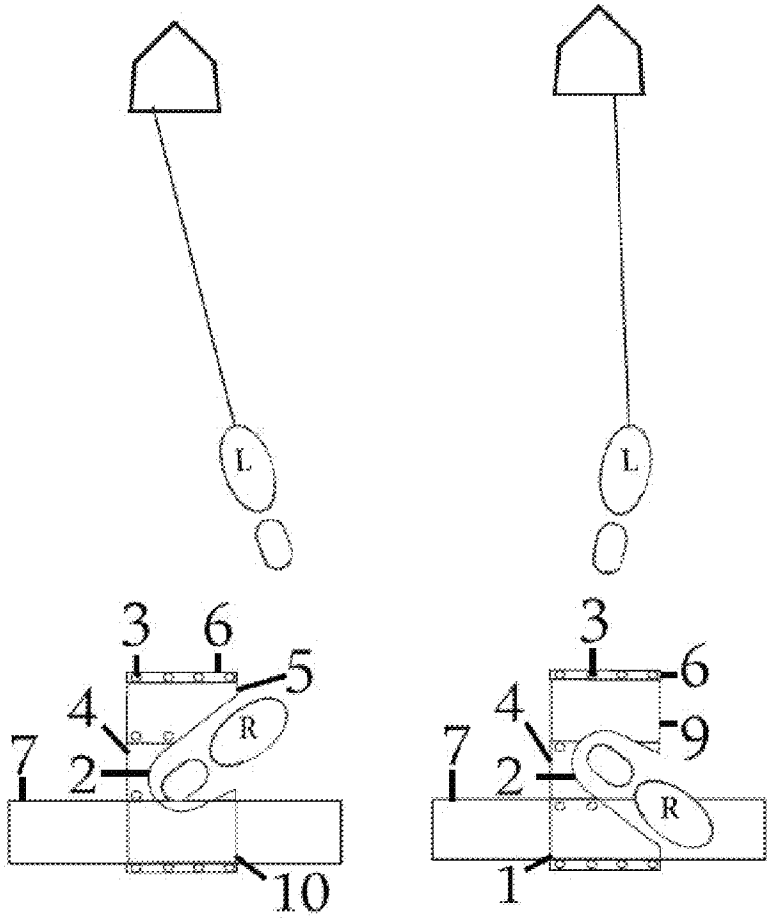
Fig 4a
Fig 4b
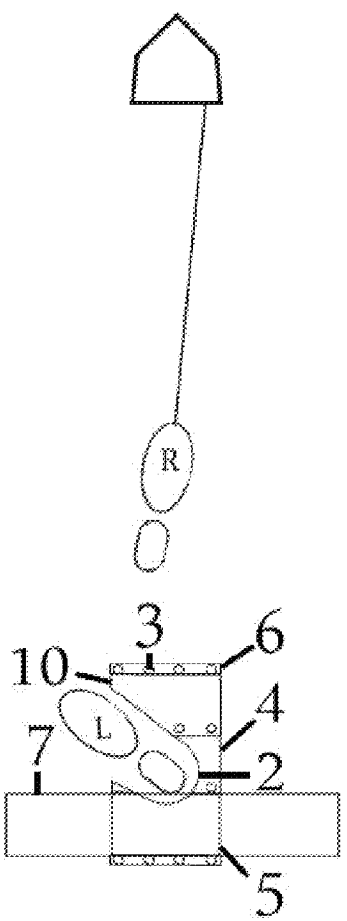
Fig 4c
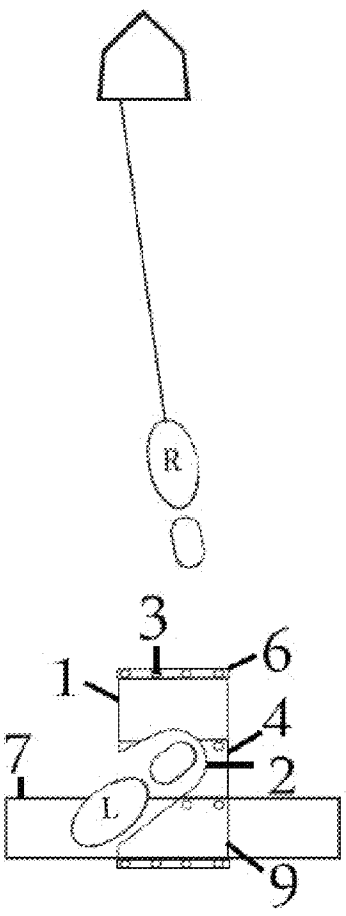
Fig 4d

PITCHERS AID FOR STRIKE ZONE ACCURACY

CROSS-REFERENCE TO RELATED APPLICATIONS

This application claims U.S. Provisional Application No. 61/268,234 filed on Jun. 10, 2009.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND

The present invention represents a significant step forward in the field of devices used for teaching of baseball. The invention was developed for the purpose of baseball pitching skill development. The present invention addresses the problems of teaching footwork, body mechanics and muscle memory not currently addressed by prior art devices.

PRIOR ART

The disclosure of Hurley (U.S. Pat. No. 7,338,395) teaches a device for retaining a baseball pitcher's foot in an orthogonal position to the line of the pitch.

The disclosure of Hurley lacks a device for retaining a baseball pitcher's foot in proper angular position to the pitcher's rubber, and also lacks holding the pitcher's footwear on three sides, and especially lacks maintaining direct footwear to pitcher's mound contact and further lacks being trapped in position and optionally locked to the pitcher's rubber and finally lacks retaining of the pitchers lead off foot in any of four positions depending on the pitching arm and delivery zone of choice.

The disclosure of Hapanowicz (Published Application US 2007/0173356, at FIG. 1*a*) teaches a device for graphically illustrating a baseball pitcher's foot in proper angular position to a user supplied attachment simulating a pitcher's rubber, by illustration of the pitcher's proper footwear position.

The disclosure of Hapanowicz lacks retaining a baseball pitcher's foot in proper angular position to the official pitcher's rubber installed on the pitcher's mound, it also lacks, holding the pitcher's footwear on three sides, it especially lacks maintaining direct footwear to pitcher's mound contact and totally lacks being trapped in position and optionally locked to the official pitcher's rubber and finally lacks retaining the pitchers lead off foot in any of four positions depending on their pitching arm and delivery zone of choice.

The disclosure of Socci (Published Application US 2004/0121862, at FIGS. 4, 7 and 8) teaches a device for sounding an alarm when a baseball pitcher's foot is not in a position where the pitcher is being taught.

The disclosure of Socci lacks retaining a baseball pitcher's foot in proper angular position to the pitcher's rubber, it also lacks holding the pitcher's footwear on three sides, it further lacks maintaining direct footwear to pitcher's mound contact and lacks being trapped in position and optionally locked to the pitcher's rubber and finally lacks retaining the pitchers lead off foot in any of four positions depending on the pitching arm and delivery zone of choice.

BRIEF SUMMARY OF THE INVENTION

The present invention is a training device for baseball pitchers. The invention solves the problem of pitching accuracy to both sides of home plate by angling a pitchers push off foot. The angle then guides the pitcher's body to the target and develops muscle memory in order to repeat the action. A study was conducted with two average high school pitchers. The first week of the study, the players were throwing to each side and were visibly having trouble locating either side. The next two weeks, each player showed visible improvement in locating to either side with greater ease and greater accuracy. In addition to solving these problems added features that secure, stabilize and provide ease of use are also provided.

The preferred embodiment of the present invention provides additional unique features by fitting over the top of the rubber exposing part of the pitching rubber in order for the pitcher to keep contact with the rubber. An indented side reduces movement back and forth and makes switching users simple. One can flip the preferred embodiment horizontally for a second angle and to go between a left-handed and right-handed users. The primary object of the present invention is to retain a baseball pitcher's foot in proper angular position to the pitching rubber to optimize the accuracy of pitching to the desired location. When tested outdoors on a regulation mound, player one and player two showed drastic improvement when throwing to either side of home plate after three weeks of use;

The biggest problem created by the invention was the angle and how far off the pitcher's rubber it angled the foot. The closer to the foot is to the pitcher's rubber, the easier and more natural the preferred embodiment feels to the player using the device. Other products on the market today that focus upon pitching training are as follows; The Roger Clemens Learn 2 Pitch which focuses upon a pitcher's follow through, Franklin's MLB Senior Pop-Up Pitcher Target which focuses upon a pitcher hitting his desired target, ThrowMAX Throwing Trainer focuses upon an fielder's correct throwing motion, and Arm Strong Throwing Bands which focus upon strengthening a pitcher's throwing arm while going through his pitching motion. Many of the trainers today rely upon a players ability to throw the baseball toward the desired target. Thus, creating bad mechanics that achieve results so the player does not think to correct his motion. My invention is best because it works in unison with the pitcher's body to provide accuracy to each side of home plate. Therefore the invention shows the pitcher how to use his body during his delivery to throw to the desired target. The invention will also help to reduce wear on a pitcher's arm because a player will learn to use more of his body when pitching.

A further object of the present invention is to retain the pitcher's foot in position by contact with two sides and the toe or heel of the pitcher's footwear;

A further object of the present invention is to duplicate the feel of the mound surface by direct contact between the footwear on both of the pitchers feet and the surface of the mound. During testing it was shown to be easier when the foot stayed in contact with the pitching rubber;

A further object of the present invention is to trap the preferred embodiment in position with respect to the pitcher's rubber for accurate placement;

A further object of the present invention is to remove-ably lock the device onto the pitcher's rubber. Two pitchers can switch using the preferred embodiment by lifting, flipping and re-securing the device with the desired angle;

A last object of the present invention is to be able to hold a right handed and left handed pitchers feet in angular position with the pitching rubber with a different angle for aiming the pitch towards the left and right sides of home plate. During the study, the two players showed the ability to repeat the foot placement for each side time and again. These and other objectives are further described in the following several views of the drawings and written specification.

BRIEF DESCRIPTION OF THE SEVERAL VIEWS OF THE DRAWING(S)

Figure 1B:
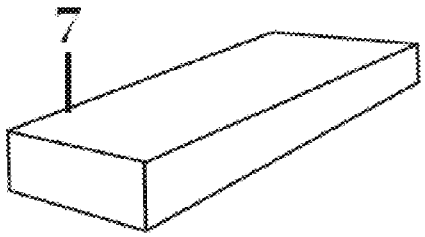
Figure 1C:
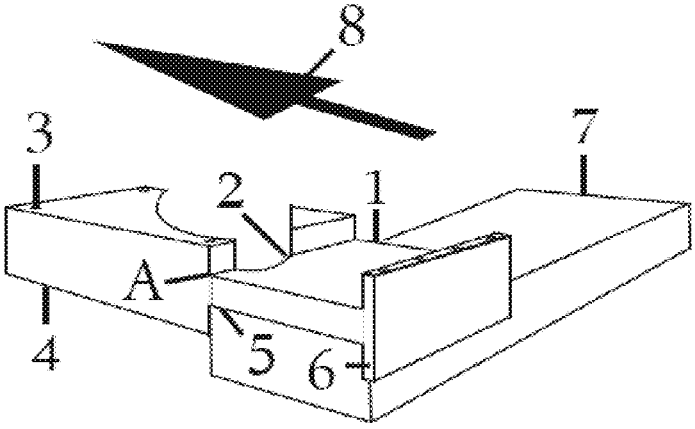
Figure 1D:
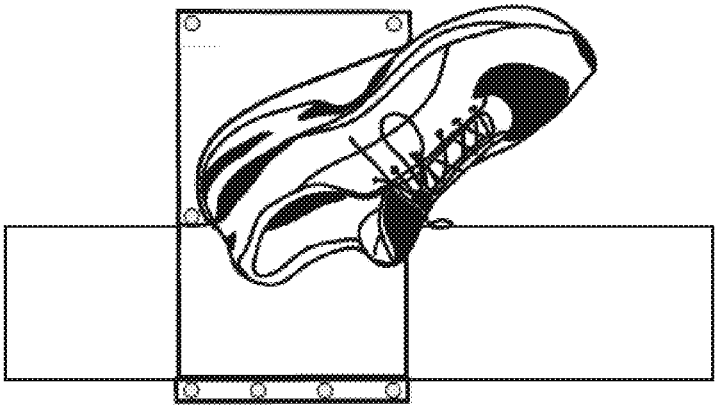

FIG. 1*a*: Is a perspective view of the preferred embodiment of the present invention;

FIG. 1*b*: Is a perspective view of the pitcher's rubber;

FIG. 1*c*: Is a perspective view of the preferred embodiment of the present invention in engagement with the pitcher's rubber;

FIG. 1*d*: Is a pictorial view of the pitchers footwear engaged with the preferred embodiment of the present invention.

Figures 2A, 2B, 2C, 2D:
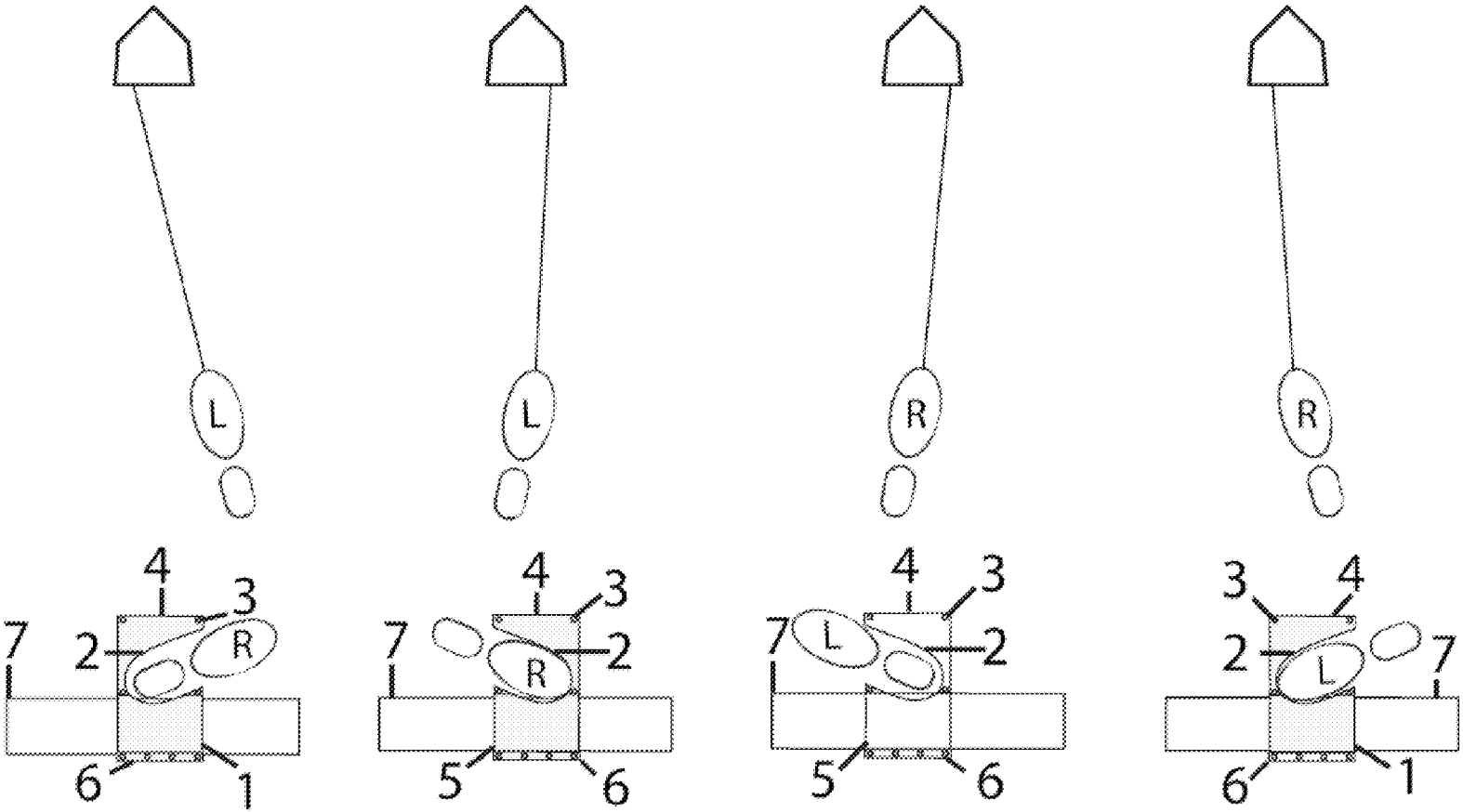
Figure 3A:
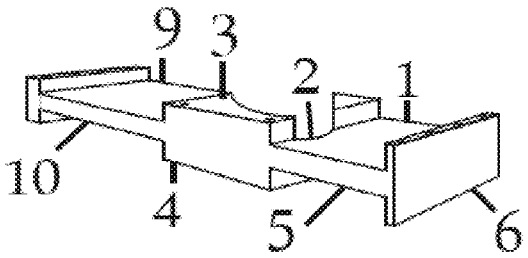
Figure 3B:
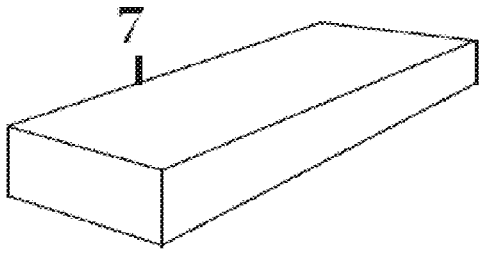
Figure 3C:
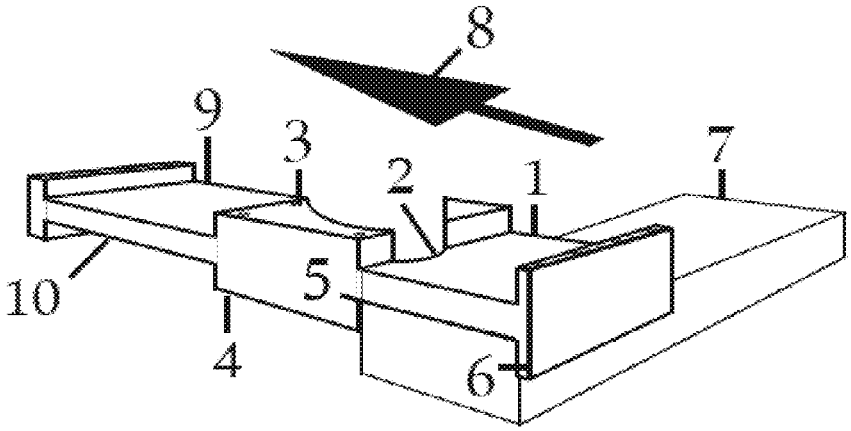
Figure 3D:
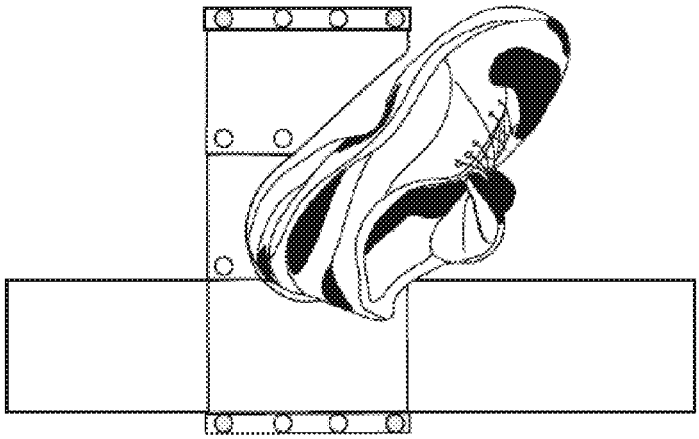

FIG. 2*a*: Is an areal view of the preferred embodiment of the present invention positioned for a right handed pitcher pitching to the left side of home plate;

FIG. 2*b*: Is an areal view of the preferred embodiment present invention positioned for a right handed pitcher pitching to the right side of home plate;

FIG. 2*c*: Is an areal view of the preferred embodiment of the present invention positioned for a left handed pitcher pitching to the right side of home plate;

FIG. 2*d*: Is an areal view of the preferred embodiment of the present invention positioned for a left handed pitcher pitching to the left of home plate;

FIG. 3*a*: Is a perspective view of a second embodiment of the present invention;

FIG. 3*b*: Is a perspective view of the pitcher's rubber;

FIG. 3*c*: Is a perspective view of the second embodiment of the present invention in engagement with the pitcher's rubber;

FIG. 3*d*: Is a pictorial view of the pitchers footwear engaged with the second embodiment of the present invention.

Figure 5A:
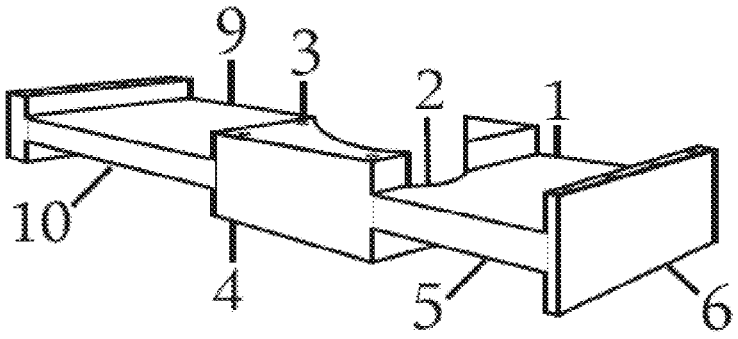
Figure 5B:
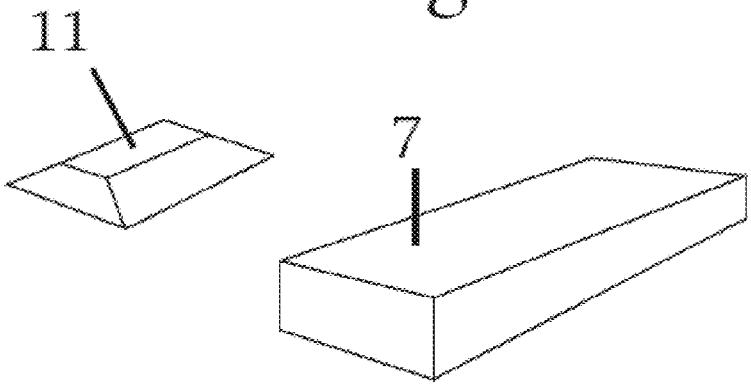
Figure 5C:
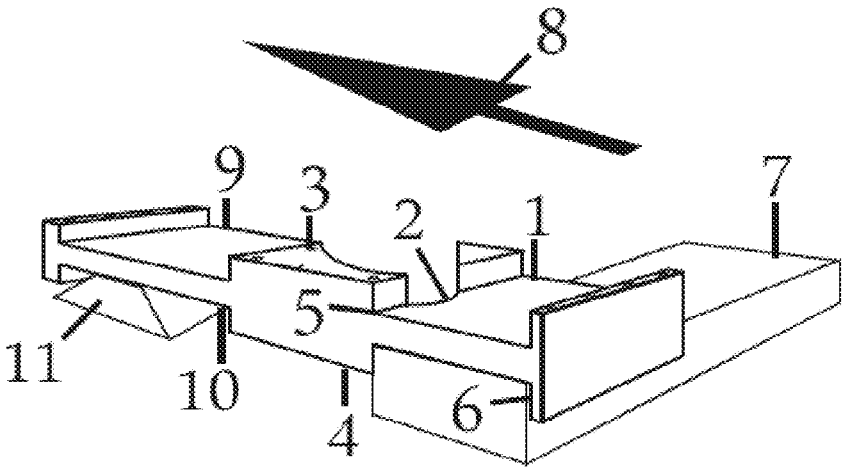
Figure 6A:
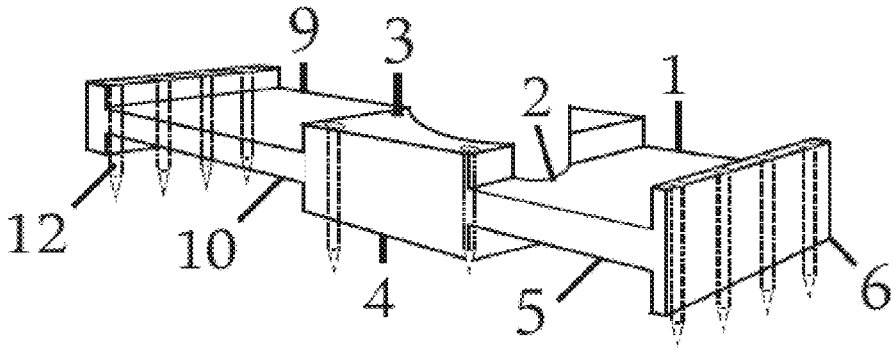
Figure 6B:
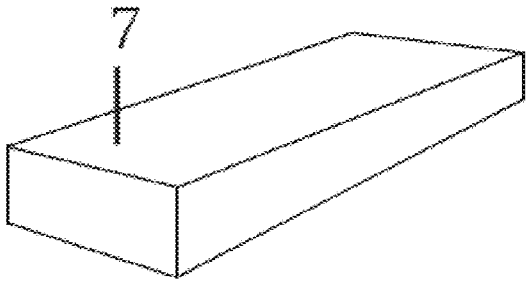
Figure 6C:
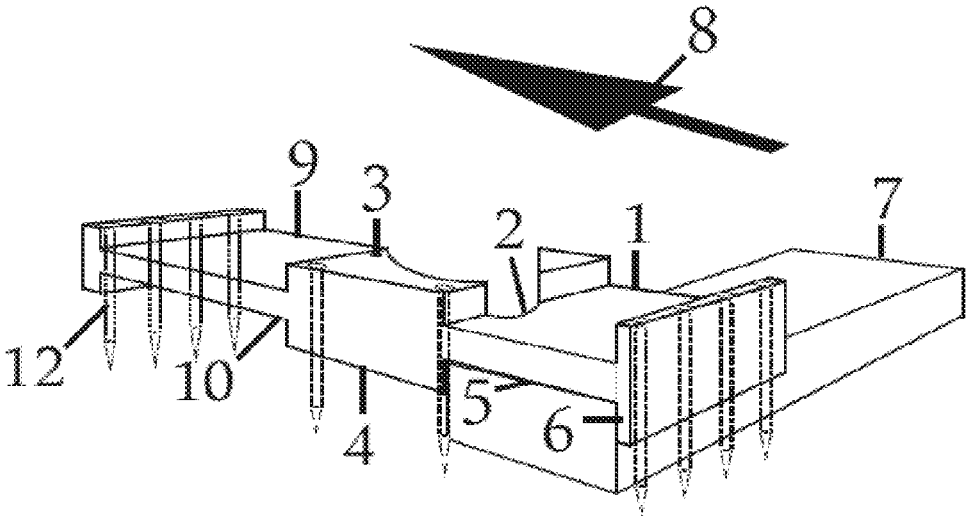
Figure 7A:
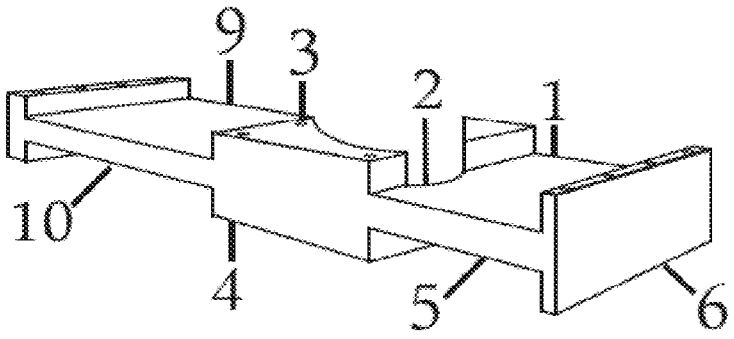
Figure 7B:
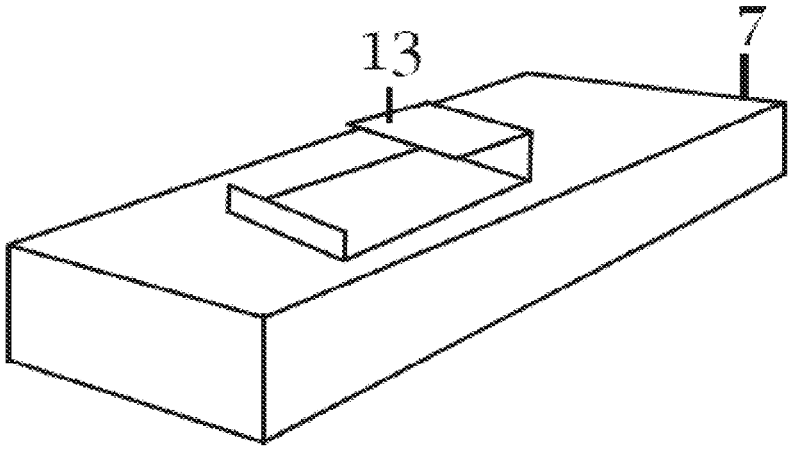
Figure 7C:
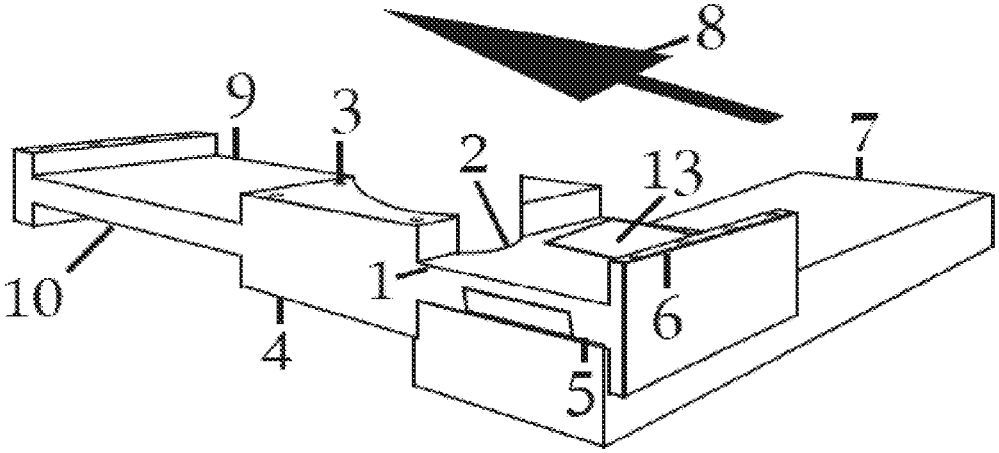
Figure 8A:
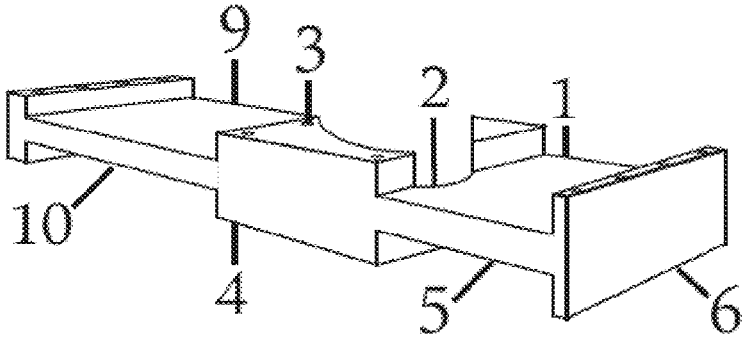
Figure 8B:
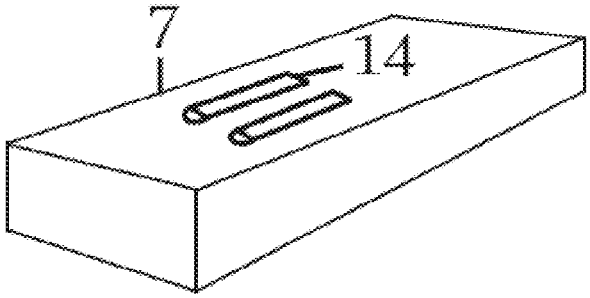
Figure 8C:
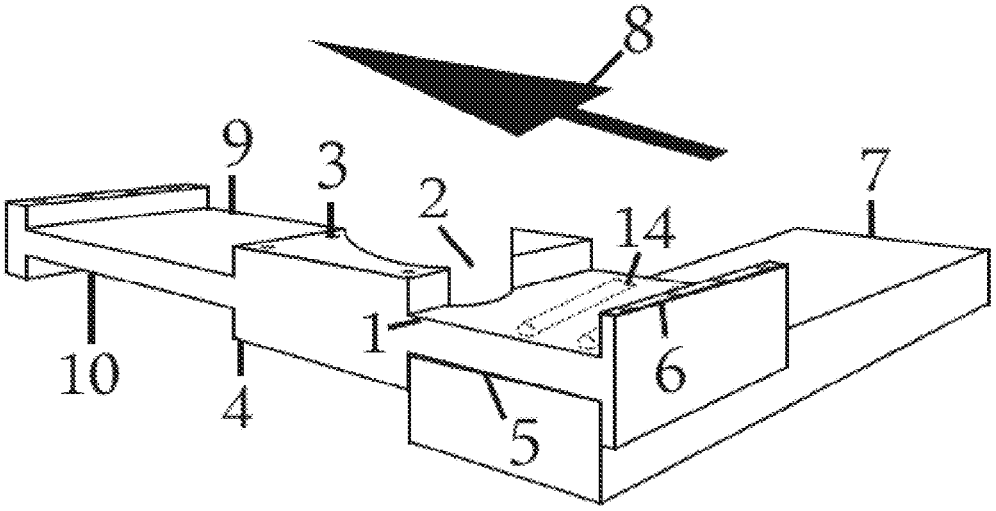
Figure 9A:
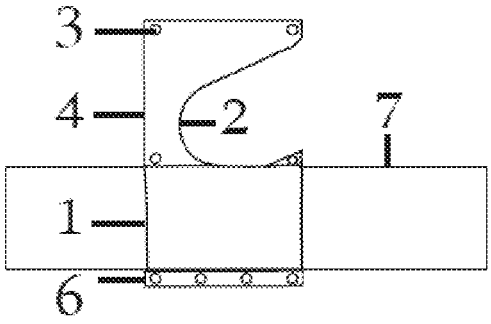
Figure 9B:
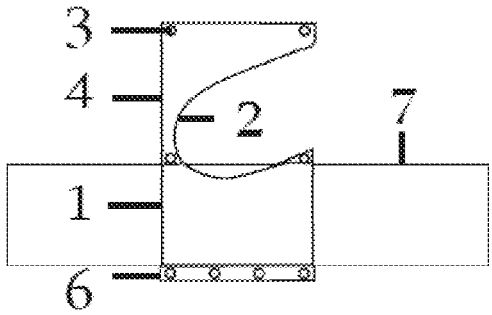
Figure 9C:
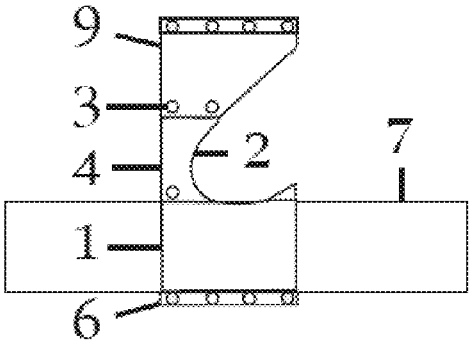
Figure 9D:
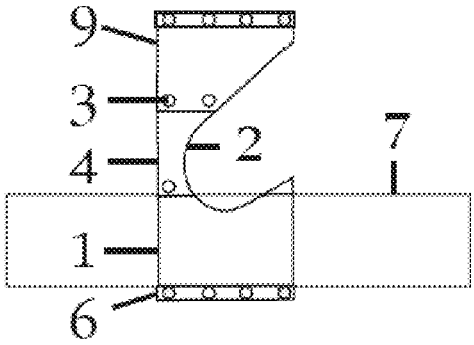

FIG. 4*a*: Is an areal view of the second embodiment of the present invention positioned for a right handed pitcher pitching to the left side of home plate;

FIG. 4*b*: Is an areal view of the second embodiment of the present invention positioned for a right handed pitcher pitching to the right side of home plate;

FIG. 4*c*: Is an areal view of the second embodiment of the present invention positioned for a left handed pitcher pitching to the right side of home plate;

FIG. 4*d*: Is an areal view of the second embodiment of the present invention positioned for a left handed pitcher pitching to the left of home plate;

FIG. 5*a*-5*c*: Is a perspective view of the second embodiment for supporting the distal end of the second embodiment of the present invention;

FIG. 6*a*-6*c*: Is a perspective view of the second embodiment for attaching an end of the second embodiment of the present invention to the pitching rubber;

FIG. 7*a*-7*c*: Is a perspective view of the second embodiment for attaching an end of the second embodiment of the present invention to the pitchers rubber;

FIG. 8*a*-8*c*: Is a perspective view of the second embodiment for attaching an end of the second embodiment of the present invention to the pitching rubber;

FIG. 9*a*: Is a perspective view of a pitchers aid where there is no opening between the shoe positioner and the groove that straddles the rubber;

FIG. 9*b*: Is a perspective view of a pitchers aid where there is a line to line opening between the shoe positioner and the groove that straddles the rubber;

FIG. 9*c*: Is a perspective view of a pitchers aid where there is no opening between the shoe positioner and the groove that straddles the rubber;

FIG. 9*d*: Is a perspective view of a pitchers aid where the opening between the shoe positioner overlaps at least half of the groove that straddles the rubber.

Figure 10A:
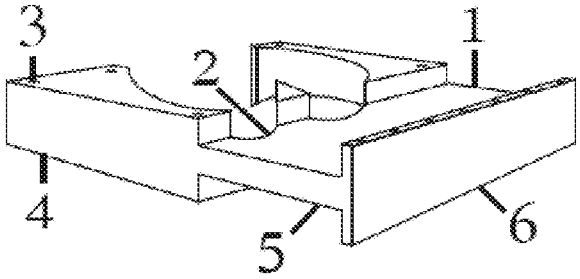
Figure 10B:
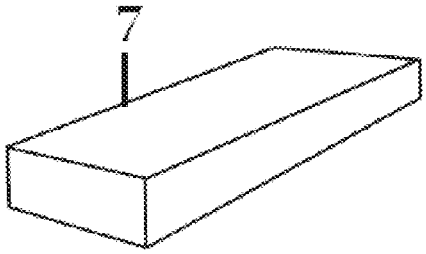
Figure 10C:
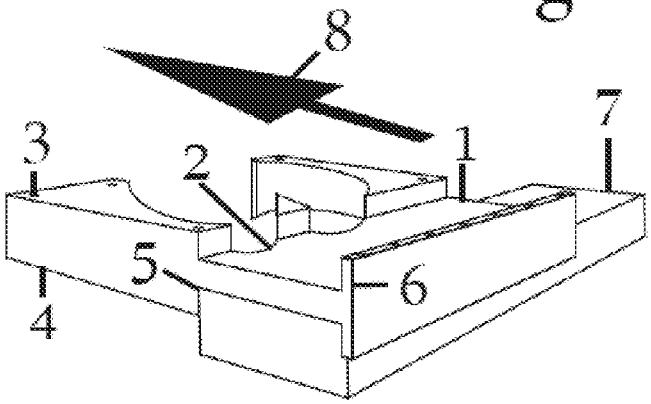
Figure 10D:
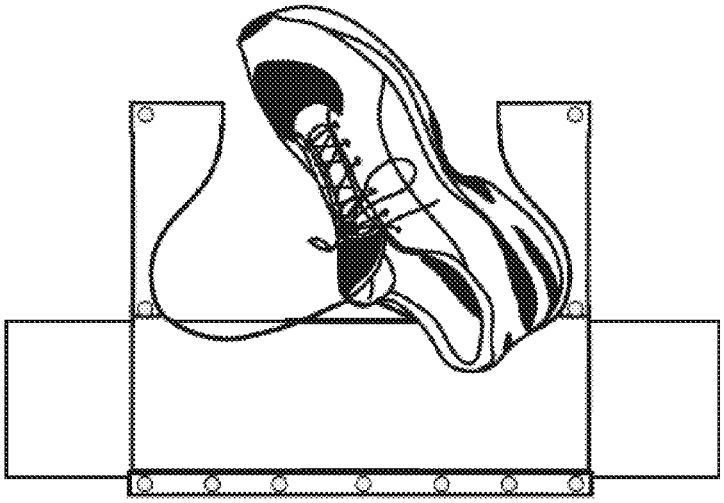

FIG. 10*a*: Is a perspective view of the third embodiment of the present invention;

FIG. 10*b*: Is a perspective view of the pitcher's rubber;

FIG. 10*c*: Is a perspective view of the third embodiment of the present invention in engagement with the pitcher's rubber;

FIG. 10*d*: Is a pictorial view of the pitchers footwear engaged with the third embodiment of the present invention.

DETAILED DESCRIPTION OF THE INVENTION

Referring to FIG. 1*a*-1*c*. The notch (1,5), interacts with the pitching rubber (7), and the main body (4) which accommodates the groove (2) and contributes to the solution of pitching accuracy by angling the push off foot from the pitching rubber (7) as shown in FIG. 1*d*. The weakest part (A) of the preferred embodiment can be reinforced by widening the area, adding fibers to the area or by adding a radius to the area. The anchor (6) interacts with the pitching rubber (7) and contributes to the solution of stabilizing the preferred embodiment over the pitching rubber (7). The holes (3) interact with the pitching rubber (7), main body (4) and anchor (6) contributing to the solution of stabilizing the device over the top of the pitching rubber (7).

Referring to FIG. 1*d*. The preferred embodiment is shown fitting over the top of the pitching rubber (7) when in use by a pitcher. The pitchers toes fit into the groove which angles his foot away from the pitching rubber (7).

Referring to FIGS. 2*a* & 2*d*. The notch (1), interacts with the pitching rubber (7), and the main body (4) which accommodates the groove (2) and contributes to the solution of pitching accuracy by angling the push off foot from the pitching rubber (7). The heel of a player interacts with the groove (2) angling a right handed pitcher to the left (FIG. 2*a*) or the toes of a player interacts with the groove (2) angling a left handed pitcher to the left (FIG. 2*d*). The anchor (6) interacts with the pitching rubber (7) and contributes to the solution of stabilizing the preferred embodiment over the pitching rubber (7). The holes (3) interact with the pitching rubber (7), main body (4) and anchor (6) contributing to the solution of stabilizing the preferred embodiment over the top of the pitching rubber (7).

Referring to FIGS. 2*b* & 2*c*. The notch (5), interacts with the pitching rubber (7), and the main body (4) which accommodates the groove (2) and contributes to the solution of pitching accuracy by angling the push off foot from the pitching rubber (7). The toes of a player interacts with the groove (2) angling a right handed pitcher to the right (FIG. 2*b*) or the heel of a player interacts with the groove (2) angling left handed pitcher to the right (FIG. 2*c*). The anchor (6) interacts with the pitching rubber (7) and contributes to the solution of stabilizing the preferred embodiment over the pitchers rubber (7). The holes (3) interact with the pitching rubber (7), main body (4) and anchor (6) contributing to the solution of stabilizing the device over the top of the pitching rubber (7).

Referring to FIG. 3*a*-3*c*. The notch (1,5), interacts with the pitching rubber (7) and the main body (4) which accommodates the groove (2) and contributes to the solution of pitching accuracy by angling the push off foot from the pitching rubber (7) as shown in FIG. 3*d*. The notch (9,10) interacts with the pitching surface and contribute to stabilization of the second embodiment. The anchor (6) interacts with the pitching rubber (7) and contributes to the solution of stabilizing the second embodiment over the pitching rubber (7). The holes (3) interact with the pitching rubber (7), main body (4) and anchor (6) contributing to the solution of stabilizing the second embodiment over the top of the pitching rubber (7) as shown in FIG. 3*d*.

Referring to FIG. 3*d*. The second embodiment is shown fitting over the top of the pitching rubber (7) when in use by a pitcher. The pitchers heel fits into the groove which angle his foot away from the pitching rubber (7).

Referring to FIG. 4*a*. The notch (10), interacts with the pitching rubber (7) and the main body (4) which accommodates the groove (2) and contributes to the solution of pitching accuracy by angling the push off foot from the pitching rubber (7) as shown in FIG. 3*d*. The heel of a player interacts with the groove (2) angling a right handed pitcher to the left. The notch (5) interacts with the pitching surface and contributes to stabilization of the second embodiment. The anchor (6) interacts with the pitching rubber (7) and contributes to the solution of stabilizing the second embodiment over the pitching rubber (7). The holes (3) interact with the pitching rubber (7), main body (4) and anchor (6) contributing to the solution of stabilizing the second embodiment over the top of the pitching rubber (7) as shown in FIG. 3*d*.

Referring to FIG. 4*b*. The notch (1), interacts with the pitching rubber (7) and the main body (4) which accommodates the groove (2) and contributes to the solution of pitching accuracy by angling the push off foot from the pitching rubber (7) as shown in FIG. 3*d*. The heel of a player interacts with the groove (2) angling a right handed pitcher to the right. The notch (9) interacts with the pitching surface and contributes to stabilization of the second embodiment. The anchor (6) interacts with the pitching rubber (7) and contributes to the solution of stabilizing the second embodiment over the pitchers rubber (7). The holes (3) interact with the pitching rubber (7), main body (4) and anchor (6) contributing to the solution of stabilizing the second embodiment over the top of the pitching rubber (7) as shown in FIG. 3*d*.

Referring to FIG. 4*c*. The notch (5), interacts with the pitching rubber (7) and the main body (4) which accommodates the groove (2) and contributes to the solution of pitching accuracy by angling the push off foot from the pitching rubber (7) as shown in FIG. 3*d*. The heel of a player interacts with the groove (2) angling a left handed pitcher to the left. The notch (10) interacts with the pitching surface and contributes to the stabilization of the second embodiment. The anchor (6) interacts with the pitching rubber (7) and contributes to the solution of stabilizing the second embodiment over the pitching rubber (7). The holes (3) interact with the pitching rubber (7), main body (4) and anchor (6) contributing to the solution of stabilizing the second embodiment over the top of the pitching rubber (7) as shown in FIG. 3*d*.

Referring to FIG. 4*d*. The notch (9), interacts with the pitching rubber (7) and the main body (4) which accommodates the groove (2) and contributes to the solution of pitching accuracy by angling the push off foot from the pitching rubber (7) as shown in FIG. 3*d*. The heel of a player interacts with the groove (2) angling a left handed pitcher to the right. The notch (1) interacts with the pitching surface and contributes to the stabilization of the second embodiment. The anchor (6) interacts with the pitching rubber (7) and contributes to the solution of stabilizing the second embodiment over the pitchers rubber (7). The holes (3) interact with the pitching rubber (7), main body (4) and anchor (6) contributing to the solution of stabilizing the second embodiment over the top of the pitching rubber (7) as shown in FIG. 3*d*.

Referring to FIG. 5*a*-5*c*. The wedge (11), interacts with the front most notch (9,10), and contributes to the solution of how one can stabilize the product while using on an indoor mound. The notch (1,5), interacts with the pitching rubber (7) and the main body (4) which accommodates the groove (2) and contributes to the solution of pitching accuracy by angling the push off foot from the pitching rubber (7) as shown in FIG. 3*d*. The anchor (6) interacts with the pitching rubber (7) and contributes to the solution of stabilizing the second embodiment over the pitching rubber (7). The holes (3) interact with the pitching rubber (7), main body (4) and anchor (6) contributing to the solution of stabilizing the second embodiment over the top of the pitching rubber (7) as shown in FIG. 3*d*.

Referring to FIG. 6*a*-6*c*. The securing nails (12), interact with the pitching rubber (7), the main body (4), the anchor (6), notch (1,5,9,10) and holes (3) contributing to the solution of how one can stabilize the product while outdoors. The notch (1,5), interacts with the pitching rubber (7) and the main body (4) which accommodates the groove (2) and contributes to the solution of pitching accuracy by angling the push off foot from the pitching rubber (7) as shown in FIG. 3*d*. The notch (9,10) interacts with the pitching surface and contributes to the stabilization of the second embodiment. The anchor (6) interacts with the pitching rubber (7) and contributes to the solution of stabilizing the second embodiment over the pitching rubber (7). The holes (3) interact with the pitching rubber (7), main body (4) and anchor (6) contributing to the solution of stabilizing the second embodiment over the top of the pitching rubber (7) as shown in FIG. 3*d*.

Referring to FIG. 7*a*-7*c*. The mound clip (13), interacts with the pitching rubber (7), and notch (1,5) and contributes to the solution of how one can stabilize the product while indoors and outdoors. The notch (1,5), interacts with the pitching rubber (7) and the main body (4) which accommodates the groove (2) and contributes to the solution of pitching accuracy by angling the push off foot from the pitching rubber (7) as shown in FIG. 3*d*. The notch (9,10) interacts with the pitching surface and contributes to the stabilization of the second embodiment. The anchor (6) interacts with the pitching rubber (7) and contributes to the solution of stabilizing the second embodiment over the pitching rubber (7). The holes (3) interact with the pitching rubber (7), main body (4) and anchor (6) contributing to the solution of stabilizing the second embodiment over the top of the pitching rubber (7) as shown in FIG. 3*d*.

Referring to FIG. 8*a*-8*c*. The mound strips (13), interacts with the pitching rubber (7), and notch (1,5) and contributes to the solution of how one can stabilize the product while indoors and outdoors. The notch (1,5), interacts with the pitching rubber (7) and the main body (4) which accommodates the groove (2) and contributes to the solution of pitching accuracy by angling the push off foot from the pitching rubber (7) as shown in FIG. 3*d*. The notch (9,10) interacts with the pitching surface and contributes to the stabilization of the second embodiment. The anchor (6) interacts with the pitching rubber (7) and contributes to the solution of stabilizing the second embodiment over the pitching rubber (7). The holes (3) interact with the pitching rubber (7), main body (4) and anchor (6) contributing to the solution of stabilizing the second embodiment over the top of the pitching rubber (7) as shown in FIG. 3*d*.

Referring to FIG. 9*a*. The notch (1), interacts with the pitching rubber (7) and the main body (4) which accommodates the groove (2) that straddles the rubber and contributes to the solution of pitching accuracy by angling the push off foot from the pitching rubber (7) as shown. The anchor (6) interacts with the pitching rubber (7) and contributes to the solution of stabilizing the second embodiment over the pitching rubber (7). The holes (3) interact with the pitching rubber (7), main body (4) and anchor (6) contributing to the solution of stabilizing the second embodiment over the top of the pitching rubber (7) as shown in FIG. 1*d*.

Referring to FIG. 9*b*. The notch (1), interacts with the pitching rubber (7) and the main body (4) which accommodates the groove (2) where there is a line to line opening between the shoe positioner and the groove that straddles the rubber and contributes to the solution of pitching accuracy by angling the push off foot from the pitching rubber (7) as shown. The anchor (6) interacts with the pitching rubber (7) and contributes to the solution of stabilizing the second embodiment over the pitching rubber (7). The holes (3) interact with the pitching rubber (7), main body (4) and anchor (6) contributing to the solution of stabilizing the second embodiment over the top of the pitching rubber (7) as shown in FIG. 1*d*.

Referring to FIG. 9*c*. The notch (1), interacts with the pitching rubber (7) and the main body (4) which accommodates the groove (2) that straddles the rubber and contributes to the solution of pitching accuracy by angling the push off foot from the pitching rubber (7) as shown. The notch (9) interacts with the pitching surface and contributes to the stabilization of the second embodiment. The anchor (6) interacts with the pitching rubber (7) and contributes to the solution of stabilizing the second embodiment over the pitching rubber (7). The holes (3) interact with the pitching rubber (7), main body (4) and anchor (6) contributing to the solution of stabilizing the second embodiment over the top of the pitching rubber (7) as shown in FIG. 3*d*.

Referring to FIG. 9*d*. The notch (1), interacts with the pitching rubber (7) and the main body (4) which accommodates the groove (2) where there is a line to line opening between the shoe positioner and the groove that straddles the rubber and contributes to the solution of pitching accuracy by angling the push off foot from the pitching rubber (7) as shown. The notch (9) interacts with the pitching surface and contributes to the stabilization of the second embodiment. The anchor (6) interacts with the pitching rubber (7) and contributes to the solution of stabilizing the second embodiment over the pitching rubber (7). The holes (3) interact with the pitching rubber (7), main body (4) and anchor (6) contributing to the solution of stabilizing the second embodiment over the top of the pitching rubber (7) as shown in FIG. 3*d*.

Although the terms and definitions used in the specification are intended to be read into the claims they are hot intended to limit the meets and bounds of the claims presented here below in any manner whatsoever.

I claim:

1. A device for positioning a pitcher's push-off foot in an angular position for optimum delivery of a pitch of a baseball, comprising:

a pitcher's aid that has a height separating two rectangular areas for resting on a pitcher's mound;

wherein a vertical projection of the two rectangular areas on the pitcher's mound forms an outline;

a "U" shaped opening extending completely through the two rectangular areas;

wherein the "U" shaped opening is for positioning a heel or a toe of the pitcher's push-off foot;

wherein a straight sides of the "U" shaped opening forms an oblique angle with a side of the two rectangular areas;

wherein the "U" shaped opening extends more than half way across each of the two rectangular areas of the pitcher's aid for positioning the pitcher's push-off foot on a common point regardless of the orientation of the pitcher's aid within the outline;

a recess with parallel walls extends completely across each of the two rectangular areas for positioning the pitcher's aid with respect to a pitcher's rubber and the home plate;

the direction of the "U" shape opening with respect to the pitcher's aid is altered by inverting the orientation of the pitcher's aid that remains positioned within the outline;

one or more holes extend through the two rectangular areas of the pitcher's aid for insertion of pointed fasteners into the pitcher's mound.

2. The device of claim 1, wherein:

the angle of the "U" shaped opening with respect to the pitcher's aid is altered by an inverted orientation of the pitcher's aid that remains positioned within the outline.

3. The device of claim 1, wherein:

the rounded portion of the "U" shaped opening breaks through a parallel wall of each of the one or more recess for the pitcher's push-off foot to have access to make contact with the pitcher's rubber.

4. The device of claim 1, wherein:

wherein the longer straight portion of the one or more "U" shaped openings breaks through a parallel wall of the one or more recess for the pitcher's foot to have access to contact with the pitcher's rubber.

5. The device of claim 1, further comprising:

one or more removable adhesive strips for temporary fastening of the pitcher's aid to the pitcher's rubber.

6. The device of claim 1, further comprising:

one or more devices with one or more removable adhesive strips for temporary fastening of a member that removeably fastens the pitcher's aid to the pitcher's rubber.

7. The device of claim 1, further comprising:

one or more spacers for support of the pitcher's aid.

8. The device of claim 1, wherein:

the direction of the "U" shape opening with respect to the pitcher's aid is altered by inverting the orientation of the pitcher's aid that remains positioned within the outline.

9. The device of claim 1, wherein:

the angle of the "U" shaped opening with respect to the pitcher's aid is altered by an inverted orientation of the pitcher's aid that is positioned within the outline.

10. A method of using the device of claim 1 for positioning a pitcher's push-off foot in a lateral position and an angle for optimum delivery of a pitch of a baseball, comprising the steps:

locating a point a desired distance from a home plate and equidistant from a first base and a third base;

orienting a pitcher's aid with the single "U" shaped opening in a position taken from the list:

i. angling towards the third base for a RH or a LH pitcher throwing to the third base side of the home plate;

ii. angling towards home plate but on a first base side for a RH or LH pitcher throwing to the first base side of home plate;

fastening the pitcher's aid in position with the point at the center of the device;

placing the push-of foot in the single "U" shaped opening;

throwing the pitch.

11. A method of using the device of claim 1 for positioning a pitcher's push-off foot in a lateral position and an angle for optimum delivery of a pitch of a baseball, comprising the steps:

locating a point a desired distance from a home plate and equidistant from a first base and a third base;

orienting a pitcher's aid with the single "U" shaped opening in a position taken from the list:

iii. angling towards the third base for a RH pitcher throwing to the third base side of the home plate;

iv. angling towards home plate but on the third base side for a RH pitcher throwing to the first base side of home plate;

v. angling towards the first base for a LH pitcher throwing to the first base side of the home plate;

vi. angling towards home plate but on the first base side for a LH pitcher throwing to the third base side of home plate;

fastening the pitcher's aid in position with the point at the center of the device;

placing the push-of foot in the single "U" shaped opening;

throwing the pitch.

12. A method of using the device of claim 1 for positioning a pitcher's push-off foot in a lateral position and an angle for optimum delivery of a pitch of a baseball, comprising the steps:

Locating a point a desired distance from a home plate and equidistant from a first base and a third base;

fastening the pitcher's aid in position with the point at the center of the device;

placing the push-of foot in the appropriate "U" shaped opening according to the list.

* * * * *